United States Patent [19]

Wright

[11] Patent Number: 4,824,492

[45] Date of Patent: Apr. 25, 1989

[54] METHOD FOR PRODUCING A PRECIPITATION HARDENABLE MARTENSITIC LOW ALLOY STEEL FORGING

[75] Inventor: Peter Wright, Duncanville, Tex.

[73] Assignee: Chaparral Steel Company, Midlothian, Tex.

[21] Appl. No.: 137,105

[22] Filed: Dec. 23, 1987

[51] Int. Cl.[4] ..... C21D 1/02

[52] U.S. Cl. ..... 148/12.4; 148/12 F

[58] Field of Search ..... 148/328, 333, 334, 335, 148/336, 12 F, 12.4; 420/105, 108–112

[56] References Cited

U.S. PATENT DOCUMENTS

| | | | |
|---|---|---|---|
| 1,746,586 | 2/1930 | Hamilton | 420/8 |
| 1,762,482 | 6/1930 | Miller | 420/123 |
| 1,979,594 | 11/1934 | Williams | 420/123 |
| 2,140,237 | 12/1938 | Leitner | 420/8 |
| 3,386,862 | 6/1968 | Johnston et al. | 148/335 |
| 3,494,765 | 2/1970 | Gondo et al. | 420/123 |
| 3,511,646 | 5/1970 | Von Scheele et al. | 420/123 |
| 3,807,990 | 4/1974 | Gohda et al. | 148/320 |
| 4,087,674 | 5/1978 | Kohira et al. | 420/8 |
| 4,300,598 | 11/1981 | Royer et al. | 148/320 |

FOREIGN PATENT DOCUMENTS

| | | | |
|---|---|---|---|
| 790867 | 2/1973 | Belgium . | |
| 794286 | 9/1968 | Canada . | |
| 45-4172 | 2/1970 | Japan . | |
| 53-60813 | 5/1978 | Japan | 420/108 |
| 57-082459 | 11/1980 | Japan . | |
| 2163454A | 2/1986 | United Kingdom . | |

*Primary Examiner*—Deborah Yee

*Attorney, Agent, or Firm*—Finnegan, Henderson, Farabow, Garrett & Dunner

[57] ABSTRACT

A precipitation-hardenable martensitic low alloy steel for use in producing forgings having an improved combination of strength and toughness. The steel may be quenched directly from forging temperature. The composition of the steel consists essentially of, in weight percent, less than 0.20 carbon, 1.0 to 2.5 manganese, 0.10 to 1.5 silicon, 0.01 to less than 1.0 of at least one carbide, nitride or carbonitride forming element which may be niobium, titanium, vandium aluminum, zirconium or tantalum, less than 0.05 nitrogen, 0.01 to less than 2.0 of at least one of molybdenum, nickel and chromium and the balance iron. The steel upon quenching directly from forging temperature has a yield strength of 90,000 to 165,000 psi, a tensile strength of 120,000 to 210,000 psi, impact energy greater than 15 foot pounds at −22° F. and a ductile-to-brittle transition temperature between minus 40° F. and −25° F.

2 Claims, No Drawings

METHOD FOR PRODUCING A PRECIPITATION HARDENABLE MARTENSITIC LOW ALLOY STEEL FORGING

BACKGROUND OF THE INVENTION

1. Field of the Invention

The invention relates to a precipitation-hardenable martensitic, low alloy steel adapted for use in the production of forgings. In accordance with the method of the invention, forgings of the steel thereof may be quenched directly from the forging temperature to achieve an excellent combination of strength and toughness.

2. Decription of the Prior Art

Carbon and low-alloy steels are conventionally used in the production of forgings. Forgings of these steels are in accordance with conventional practice air cooled from the forging temperature. Thereafter, the forging is heat treated, including controlled quenching, to achieve the desired tempered martensitic structure for a combination of good strength and toughness. These forgings are characterized, after heat-treatment and quenching, by hardness levels in the Rockwell C (Rc) hardness range of 20 to 55 and tensile strengths of 100,000 to 280,000 psi, along with a level of Charpy V-notch impact energy of between 20 and 115 ft-lbs at room temperature with ductile-to-brittle transition temperatures ranging from −200° F. to +100° F.

In the production of conventional forgings of this type, however, the steel is air cooled from forging temperature and thus reheating is required to achieve the desired tempered martensitic structure for obtaining the desired mechanical properties. Consequently, separate heating operations are required for heating to forging temperature and thereafter additional heating for tempering is required.

SUMMARY OF THE INVENTION

It is accordingly an object of the present invention to provide a low alloy steel for use in the production of forgings that does not require heating for tempering after forging to achieve the desired tempered martensitic structure.

The precipitation-hardenable, auto tempering, martensitic, low alloy steel of the invention consists essentially of, in weight percent, less than 0.20 carbon, 1.0 to 2.5 manganese, 0.10 to 1.5 silicon, .01 to less than 1.0 of at least one carbide, nitride or carbonitride forming element selected from the group consisting of niobium, titanium, vanadium, aluminum, zirconium and tantalum, less than 0.05 nitrogen, 0.01 to less than 2.0 of at least one element selected from the group consisting of molybdenum, nickel and chromium and the balance iron. The steel upon quenching directly from the forging temperature has a yield strength of 90,000 to 165,000 psi, a tensile strength of 120,000 to 210,000 psi, impact energy level greater than 15 foot pounds at −22° F. and a ductile-to-brittle transition temperature between −40° F. and +25° F.

In accordance with the method of the invention, the steel is forged and directly from the forging temperature the steel is quenched at a rate sufficient to achieve an auto tempered martensitic structure having the mechanical properties set forth above. The forging is quenched directly from forging temperature. Preferably, the quenching is by water quenching.

With respect to the steel of the invention and the forging made therefrom, the composition thereof ensures that forging may be completed within the austenitic temperature range, which broadly is within the temperature range of 1800° to 2300° F. for a steel within the composition limits of the invention. The quenching rate is sufficient to achieve the desired auto tempered martensitic structure. The transormation to martensite is at a quench rate such that undesirable transformation products such as proeutectoid ferrite, pearlite and bainite do not result. For this purpose, elements such as manganese, silicon, molybdenum, nickel and chromium are employed to retard transformation to these non-martensitic transformation products during quenching. The amount of these alloying constituents required for this purpose is a function of the cross-sectional area of the forging. Manganese is the preferred element for this purpose, primarily from the cost standpoint.

Toughness is achieved with the steel and forging of the invention by the use of carbide, nitride or carbonitride forming elements for carbon and nitrogen passivation and grain refinement at forging temperatures. This is achieved by grain-boundary pinning by undissolved carbides, nitrides and carbonitrides present at the grain boundaries. These elements are partially in solution during forging and precipitate as carbides, nitrides and carbonitrides during controlled quenching from the final forging temperature.

With respect to the composition of the steel of the invention, the carbon content provides for strength and hardness during quenching to martensite. As the carbon content increases so does the maximum strength potential of the steel. If the carbon content exceeds 0.20%, the Ms and Mf temperatures (martensitic tranformation temperature range) become too low for effective tempering with the crystallinity of the martensite causing increased distortion during quenching. No lower limit is set for carbon, because as the carbon content is decreased, strength will be reduced but improved toughness will result.

Manganese is the primary hardenability element in the steel of the invention and 1.0% manganese minimum is necessary to ensure adequate hardenability. The manganese content will increase within the range of the invention as the cross-sectional area of the forging increases.

Silicon is limited to 1.5%, because above this amount low temperature toughness is degraded. A minimum silicon content of 0.1% is required but silicon must be controlled within the range of the invention to maintain a proper manganese-to-silicon ratio on the order of 3:1 to ensure that the alloy may be effectively produced by continuous casting.

The carbide, nitride and carbonitride forming elements are added in quantities that will combine with carbon and nitrogen to provide adequate grain refinement at the processing temperatures. Niobium is a better grain refiner at elevated temperatures than vanadium, and when present in quantities of about 0.1% produces a fine grained steel when forged at temperatures of about 2100° F.

Nitrogen should be present in amounts sufficient to combine, along with carbon, with the grain refining elements to produce nitrides and carbonitrides at the processing temperatures. Nitrogen in excess of about 0.05%, however, impairs the toughness and ductility of the steel.

The hardenability intensifying elements molybdenum, nickel and chromium may be added to the steel to increase the hardenability thereof, particularly in forgings of increased cross-sectional area. In addition, the presence of nickel improves the low temperature toughness of the alloy.

DESCRIPTION OF THE PREFERRED EMBODIMENTS

Table 1 lists the chemical compositions of a series of steels that were produced within the composition limits of the invention. Calculated values of Ms and Mf temperatures are also listed in Table 1.

TABLE 1

CHEMISTRIES AND CALCULATED Ms AND Mi TEMPERATURES OF EXAMPLE OF THE INVENTION

| GRADE | HEAT # | % C | % MN | % P | % S | % SI | % CU | % NI | % CR | % MO | % V | % NB | % AL | % N | Ms TEMP (F.) | Mf TEMP (F.) |
|---|---|---|---|---|---|---|---|---|---|---|---|---|---|---|---|---|
| M7-13C | 4-2437 | 0.13 | 1.74 | 0.020 | 0.038 | 0.69 | 0.29 | 0.11 | 0.14 | 0.20 | 0.14 | 0.11 | 0.008 | 0.014 | 820 | 435 |
| M7-17C | 4-2234 | 0.17 | 1.60 | 0.012 | 0.022 | 0.58 | 0.23 | 0.13 | 0.14 | 0.15 | 0.10 | 0.11 | 0.007 | 0.011 | 786 | 401 |
| M8 | 4-1157 | 0.11 | 1.80 | 0.015 | 0.026 | 0.46 | 0.29 | 0.08 | 0.09 | 0.02 | 0.10 | 0.095 | 0.004 | 0.013 | 842 | 457 |
| M9 | 4-1158 | 0.13 | 1.80 | 0.014 | 0.020 | 0.62 | 0.29 | 0.08 | 0.09 | 0.17 | 0.11 | | | 0.012 | 820 | 435 |
| M10 | 4-2244 | 0.14 | 1.73 | 0.014 | 0.025 | 0.54 | 0.32 | 0.12 | 0.14 | 0.19 | | 0.11 | 0.007 | | 810 | 425 |
| M11 | 4-2891 | 0.09 | 1.51 | 0.015 | 0.040 | 0.44 | 0.22 | 0.11 | 0.13 | 0.20 | | | | 0.012 | 861 | 476 |
| M12 | 4-2892 | 0.09 | 1.76 | 0.016 | 0.032 | 0.69 | 0.28 | 0.12 | 0.20 | 0.24 | 0.11 | 0.11 | | 0.012 | 858 | 473 |
| M13 | 4-3471 | 0.13 | 1.72 | 0.010 | 0.029 | 0.61 | 0.34 | 0.15 | 0.18 | 0.05 | | | 0.005 | | 822 | 437 |
| M14 | 4-3472 | 0.13 | 2.01 | 0.010 | 0.023 | 0.60 | 0.30 | 0.14 | 0.15 | 0.22 | | | 0.005 | | 814 | 429 |

The formulas used to calculate the Ms and Mf values were: $Ms(1F) = 1.8[512 - 453(\%\ C) - 16.9(\%\ Ni) + 15(\%\ Cr) - 9.5(\%\ Mo) + 217(\%\ C)(\%\ C) - 71.5(\%\ C)(\%\ Mn) - 67.6(\%\ C)] + 32$. $Mf(1F) = Ms - 385$.

TABLE 2

MECHANICAL PROPERTIES AND GRAIN SIZES OF EXAMPLES OF THE INVENTION

| GRADE | YIELD (psi) | TENSILE (psi) | % ELONG | % ROA | CVN −76° F. (FT-LBS) | CVN −22° F. (FT-LBS) | CVN +32° F. (FT-LBS) | CVN +86° F. (FT-LBS) | CVN +140° F. (FT-LBS) | ROCK-WELL C | BHN | ASTM GRAIN SIZE |
|---|---|---|---|---|---|---|---|---|---|---|---|---|
| M7 13C | 152,692 | 185,300 | 11 | 39 | 11 | 24 | 31 | 37 | 40 | 40 | 388 | 7 |
| M7 17C | 162,053 | 203,322 | 9 | 24 | 18 | 23 | 32 | 37 | 42 | 44 | 439 | 7 |
| M8 | 151,349 | 180,819 | 14 | 54 | 15 | 27 | 43 | 47 | 47 | 39 | 384 | 7 |
| M9 | 153,011 | 185,094 | 12 | 40 | 17 | 26 | 34 | 37 | 41 | 39 | 380 | 4–5 |
| M10 | 158,943 | 194,965 | 13 | 47 | 22 | 30 | 44 | 52 | 48 | 40 | 397 | 7 |
| M11 | 124,310 | 152,882 | 16 | 49 | 13 | 15 | 24 | 39 | 37 | 32 | 296 | 2–3 |
| M12 | 148,662 | 168,483 | 14 | 51 | 18 | 32 | 40 | 55 | 60 | 37 | 360 | 6–7 |
| M13 | 151,988 | 188,223 | 10 | 24 | 16 | 20 | 27 | 34 | 38 | 40 | 397 | 2–3 |
| M14 | 154,624 | 192,016 | 11 | 37 | 10 | 16 | 34 | 42 | 44 | 41 | 410 | 4–5 |

As may be seen from the data presented in Table 2, the steels in accordance with the invention when quenched from conventional forging temperatures exhibited an excellent combination of strength and toughness and were characterized by a relatively fine grain structure.

It may be seen from this data, therefore, that excellent combinations of strength and toughness may be achieved in accordance with the invention by controlled quenching from the forging temperature. This results in significant cost savings with respect to processing, because reheating for tempering after cooling from forging temperature in accordance with conventional practice is not required.

What is claimed is:

1. A method for producing a forging of a precipitation-hardenable, martensitic, low alloy steel, said method comprising, forging a steel consisting essentially of, in weight percent, less than 0.20 carbon, 1.0 to 2.5 manganese, 0.10 to 1.5 silicon, 0.01 to less than 1.0 of at least one carbide, nitride or carbonitride forming element selected from the group consisting of niobium, titanium, vanadium, aluminum, zirconium and tantalum, less than 0.05 nitrogen, 0.01 to less than 2.0 of at least one element selected from the group consisting of molybdenum, nickel and chromium and the balance iron and incidental impurities, completing said forging at a temperature of 1800° to 2300° F., directly quenching said forging at a rate sufficient to achieve a tempered martensitic structure, said forging having a yield strength of 90,000 to 165,000 psi, a tensile strength of 120,000 to 210,000 psi, impact energy greater than 15 ft-lbs at −22° F. and a ductile-to-brittle transition temperature between −40° F. and +25° F.

2. The method of claim 1 wherein said quenching is water quenching.

* * * * *